United States Patent [19]

Petersen, III

[11] 4,385,424

[45] May 31, 1983

[54] SAFETY BELT BUCKLE

[75] Inventor: Carl M. Petersen, III, Drayton Plains, Mich.

[73] Assignee: Irvin Industries Inc., Madison Heights, Mich.

[21] Appl. No.: 161,424

[22] Filed: Jun. 20, 1980

[51] Int. Cl.[3] ..... A44B 11/26

[52] U.S. Cl. ..... 24/230 A

[58] Field of Search ..... 24/230 R, 230 A, 230 BC, 24/230 TC, 230 AK, 230 AL, 230 AD

[56] References Cited

U.S. PATENT DOCUMENTS

| | | | |
|---|---|---|---|
| Re. 27,438 | 7/1972 | Humphrey | 24/230 A |
| 3,364,531 | 1/1968 | Moss | 24/230 A |
| 3,465,393 | 9/1969 | Fisher | 24/230 A |
| 3,574,902 | 4/1971 | Lohr | 24/230 A |
| 3,588,969 | 6/1971 | Fisher | 24/230 A |
| 3,605,207 | 9/1971 | Glauser et al. | 24/230 A X |
| 3,846,876 | 11/1974 | Weman | 24/230 A |
| 3,965,603 | 5/1976 | Fisher | 24/230 A X |
| 4,092,767 | 6/1978 | Narayan | 24/230 AL |
| 4,195,392 | 4/1980 | Ueda et al. | 24/230 A |

FOREIGN PATENT DOCUMENTS

| | | | |
|---|---|---|---|
| 1398333 | 6/1975 | United Kingdom | 24/230 A |

*Primary Examiner*—Thomas J. Holko

[57] ABSTRACT

A safety belt buckle comprising a frame detachably coupled with a belt tongue, each secured to the end of a belt, the tongue having a latch opening, the frame having a reaction flange for pivotal engagement with a latch lever having a projection formed for displaceable engagement and disengagement in the latch opening. A plastic housing within the frame is recessed to accommodate the lever, cooperate with the frame to guide the tongue, and to provide spring reaction means for a push button spring mounted on a displaced integral push button seat formed in the lever. A cover with an access opening for the push button completes the assembly of frame, lever, housing and push button spring elements.

17 Claims, 14 Drawing Figures

SAFETY BELT BUCKLE

BACKGROUND OF THE INVENTION

Known prior art safety belt buckle constructions are disclosed in the following U.S. Pat. Nos. 3,131,451; 3,237,258; 3,242,546; 3,274,655; 3,277,548; 3,449,800; 3,465,393; 3,483,599; 3,588,969; 3,623,191; 3,639,951; 3,686,720; 3,716,895; 4,015,094; 4,052,775; 4,060,879; 4,064,603. The closest known prior art construction is disclosed in U.S. Pat. No. 3,588,969.

Some of the problems in prior art constructions which the present invention is directed to overcome include the following:

a. high release efforts under 150 pound loop load generally very close to 30 pound maximum government mandated release pressure;
b. high insertion efforts due to high output spring under latch;
c. high cost and low reliability of making "J" shape in front of buckle for lever retention and reaction;
d. high cost of fabrication and assembly due to number of component parts involved.

SUMMARY OF THE INVENTION

The safety belt buckle of the present invention employs an "L" flange rather than "J" for latch lever reaction. No spring under the latch lever is required and the outer lip of the J form for retaining reaction end of the latch lever is not required. The gradual ramp angle on the latch projection of the lever together with relatively light spring load minimize insertion forces required to latch the tongue. The light spring load also contributes to minimizing release pressures required under high loop loads. The push button is constructed with integral spring arms which react on columns provided in a plastic housing eliminating the need for a spring under the latch lever. The push button spring is directly attached to the lever to utilize the spring of the push button to keep the lever in the locked position. The lever is so constructed that a thick pad is available under the push button area suitable for either mylar decal or die cast emblem.

The lever contains two side column members which compress under load to provide optimum distribution of load and spring back to substantially the initial lever position upon release of load.

The buckle has a plastic housing which provides the following functions:

a. a front lead in cooperating with the frame for easy tongue insertion;
b. an area which supports the tongue for positive latch stripping when the push button is depressed for releasing the buckle;
c. columns for push button spring reaction force to maintain the lever with correct preload bias;
d. provide material around the webbing slot of the frame to distribute loading of the webbing and eliminate "cutting";
e. provide an area for housing electrical switch components;
f. keeps lever located in assembly.

In a preferred embodiment of the invention a metal cover is provided which snaps into assembled relation with the frame over the latch lever and push button with integral spring. In a modified construction a plastic cover is employed which registers with flanges of the frame to provide required crush strength to meet standard specifications in an area occupied by the integral spring arms of the push button in the preferred embodiment. Accordingly, a separate formed wire spring is provided for biasing the latch lever and push button into normally latched position.

In summary the buckle accomplishes goals of reducing release forces, insertion efforts, and costs, provides higher reliability and facilitates automated assembly operations.

BRIEF DESCRIPTION OF THE DRAWINGS

With reference to FIGS. 5–10 the component parts include metal tongue 11, metal frame 12, plastic housing 13, latch lever 14, push button spring 15 and cover 16. The tongue is a flat metal stamping plate, having a latch opening 17, rounded nose 18, frame nesting shoulders 19, rounded or angled to avoid finger pinching, and L-shaped slot 20 for belt web connection, the tongue being turned over for left and right buckle connections.

Figure 1:
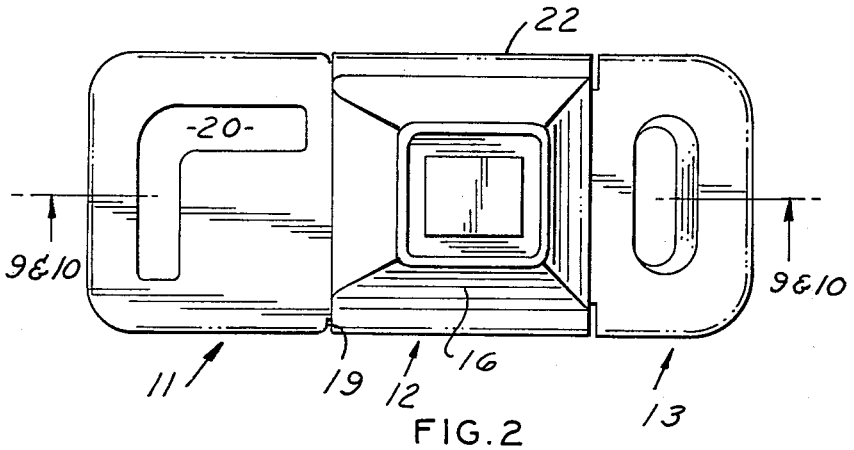
FIG. 1 is a plan view of the safety belt buckle assembly.
Figure 2:
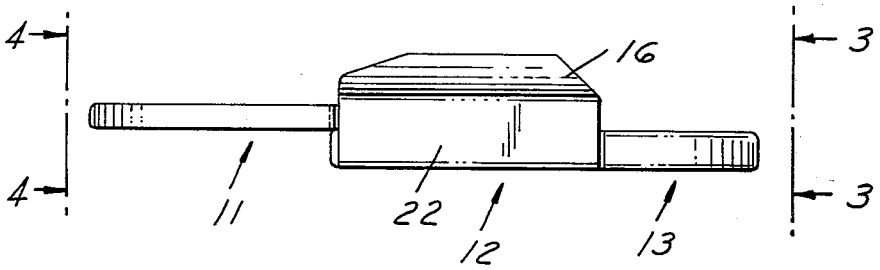
FIG. 2 is a side elevation of the assembly.
Figure 3:
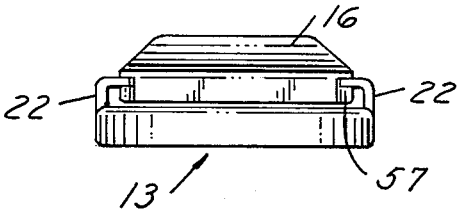
FIG. 3 is an end view taken along the line 3—3 of FIG. 2.
Figure 4:
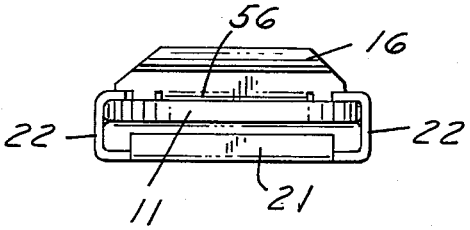
FIG. 4 is an end elevation taken along the line 4—4 of FIG. 2.

The frame is a metal stamping having reaction flange 21, channel sides 22, with struck projections 23, notched ends 24, and belt webbing slot 25. The tongue and frame are preferably made of SAE 4130 cold roll steel heat treated to Rc 42-46 after stamping. The plastic housing, preferably injection molded Celcon M-90-04, Delrin 500 or engineering equivalent material, has a center opening 26 accommodating insertion of latch lever 14, end recess 27 for reaction flange 21 of the frame, side recesses 28 for projecting ends 29 of lever 14, guide surface 30 terminating in arcuate shoulders 31 for the inserted end of tongue 11, stripping surface 32 for supporting the end 33 of tongue 11 beyond its latch opening 17, a recessed portion 34 for housing electrical switch elements, pillars 35 for supporting spring ends 36 of push button 15, and recessed end 37 slotted at 38 to serve as a cover for the webbing engaging end 39 of the frame with shoulders 40 for abutting ends 41 of frame channels 22.

The lever comprises a high strength metal stamping, preferably SAE 4130 cold rolled steel heat treated after forming to Rc 46-49. It has arcuate reaction legs 42 struck from the main body on either side with coined radiused ends 43 for engaging reaction flange 21 of frame 12; projections 29 nesting in recesses 28 in housing 13; flat ramp surface 44 and guiding tongue end 33 upon insertion to engagement of latch end 45 struck from the center of the lever; upwardly formed side arms 47 notched at 48 to accommodate spring ends 36 of push button 15 with extremities 49 for engaging formed hook portions 50 of the push button; and push button support pad 46, struck from the center of the lever beyond latch end 45, projecting from the ends of extremities 49.

Spring push button 15 is a metal stamping, preferably formed of SAE 1075 steel, stress relieved after forming and heat treated to Rc 44-48, having in addition to the hook ends for engaging the lever, struck tab projection 51 for engaging notch 52 in the push button pad of the lever, a pair of spring arms 53 and emblem 54 suitably secured to the center of the push button. Typical standard specifications met by this disclosed construction require that buckles must release with a 3 lb. tension load on the latch plate with a push button force of 2–8 lbs; also that buckles shall meet all functional requirements after 25,000 cycles of operation.

Cover 16 comprises a metal stamping, preferably formed from cold rolled steel such as SAE 4130 heat treated, and is provided with center rolled opening 55 providing access to the push button, "J" formed end 56 for guiding the tongue 33 into buckle frame 12 and for engaging projections 23 struck from channels 22 of the frame, and notched flange 57 to snap over and engage extremities 58, frame channels 22, the end of flange 57 being adapted to engage shoulder 59 to retain plastic housing and interior parts assembled thereto in fully assembled relation.

Figure 6:
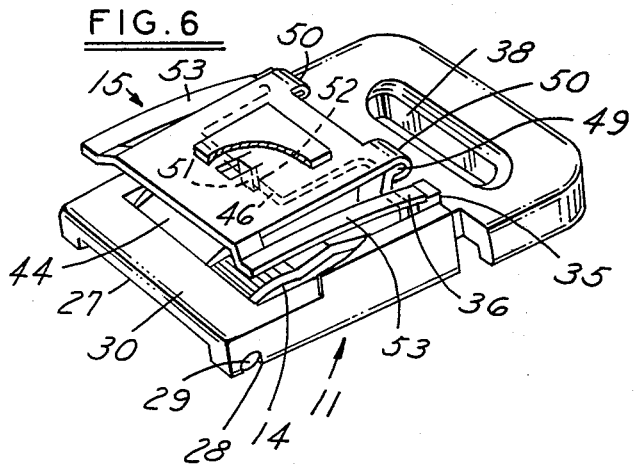
FIG. 6 is a perspective view showing the sub-assembly of the housing, lever and push button spring shown in FIG. 5.

Referring to the sub-assembly of FIG. 6 the relationship of housing 13, spring push button 15 and latch lever 14 is illustrated with hook ends 50 of the push button spring engaging projections 49 of the lever, the push button center being seated on pad 46 with projection 51 engaging notch 52, ends 36 of spring arms 53 engaging plastic housing pillars 35, and projections 29 of the lever engaging side recesses 28 of the housing.

Figure 7:
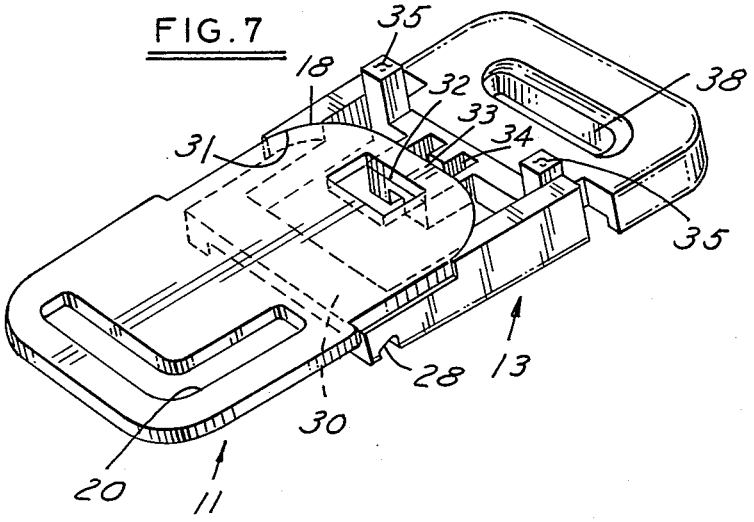
FIG. 7 is a perspective sub-assembly of the tongue and housing members shown in FIG. 5.

FIG. 7 illustrates the assembled relationship of tongue 11 with housing 13 including the nesting of arcuate tongue extremities with arcuate housing shoulders 31 and engagement of guide surface 30 and stripping surface 32 with the main body and tongue end 33, and the adjacent relationship of tongue end 33 with the electrical switch recessed portion 34.

Figure 8:
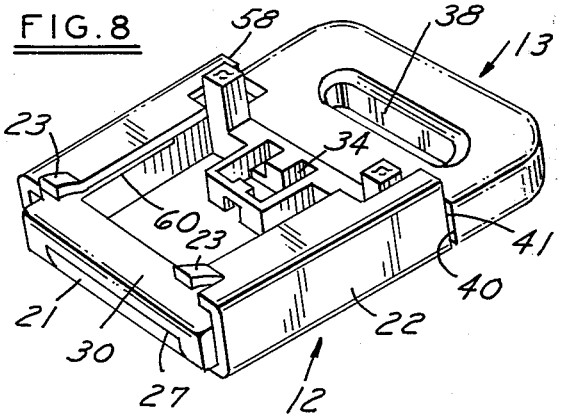
FIG. 8 is a perspective sub-assembly of the frame and housing members shown in FIG. 5.

FIG. 8 illustrates the nested assembled relationship of frame 12 with housing 13 including guide recess 60 between such elements for the tongue.

Figure 9:
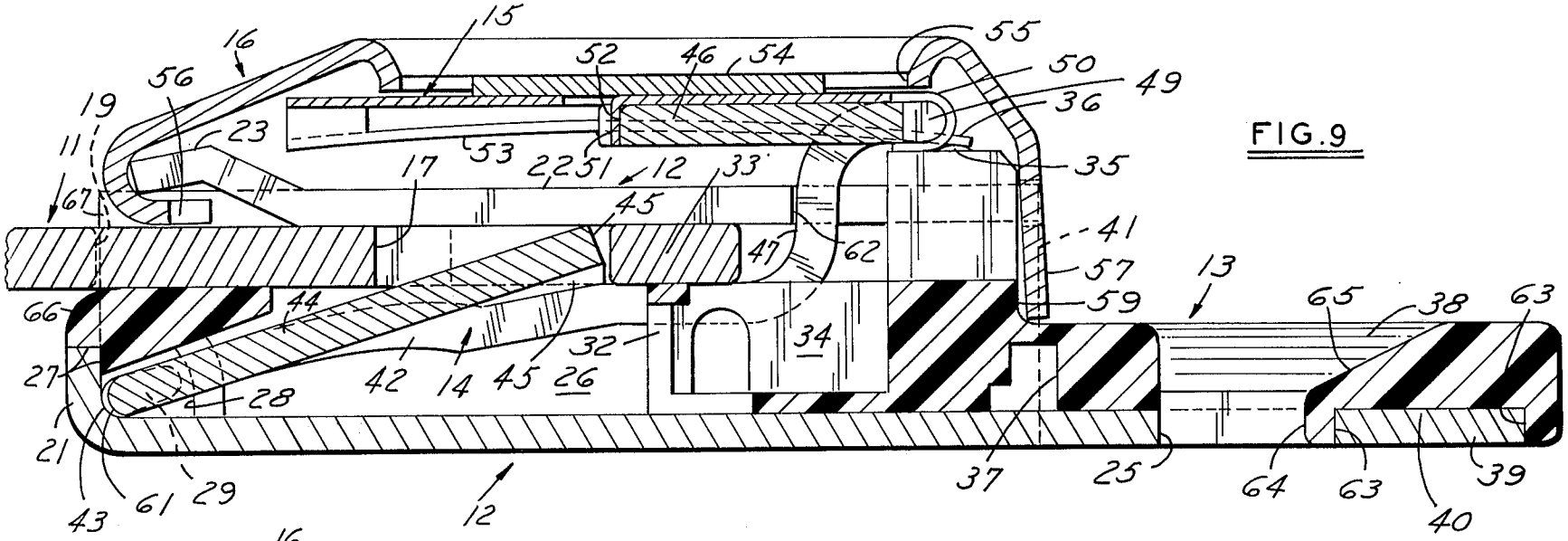
FIGS. 9 and 10 are enlarged sectional views taken along the line 9 and 10 of FIG. 1 showing respectively the latched and release relationship of all buckle components.
Figure 10:
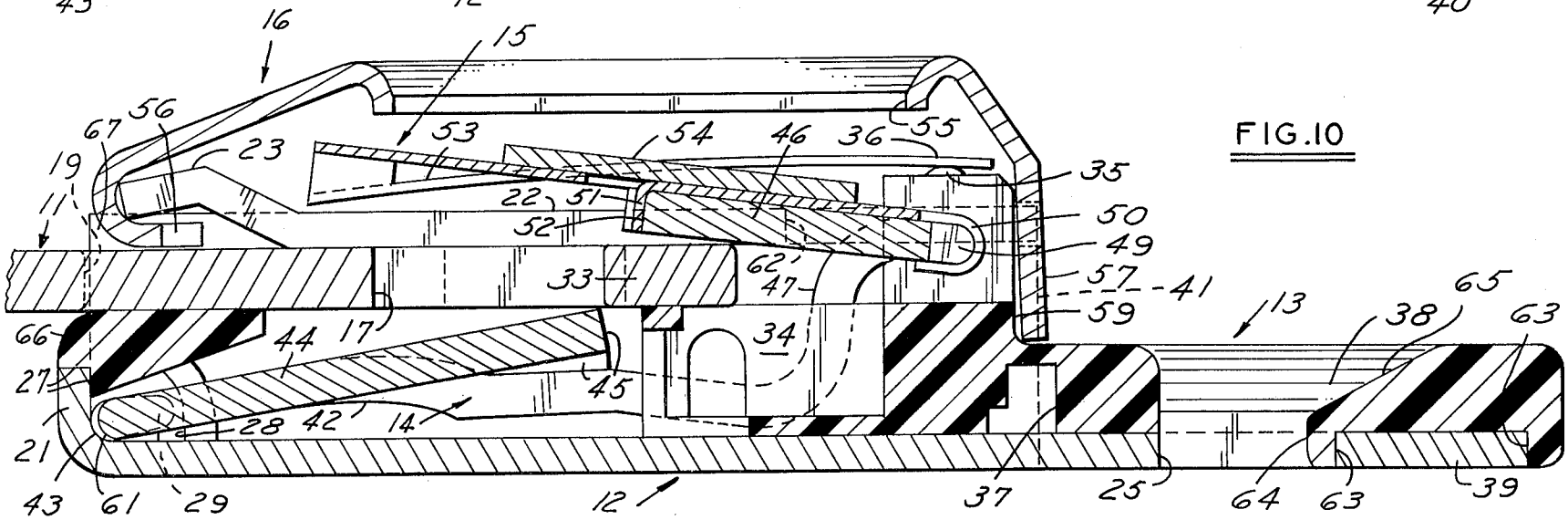
Figure 11:
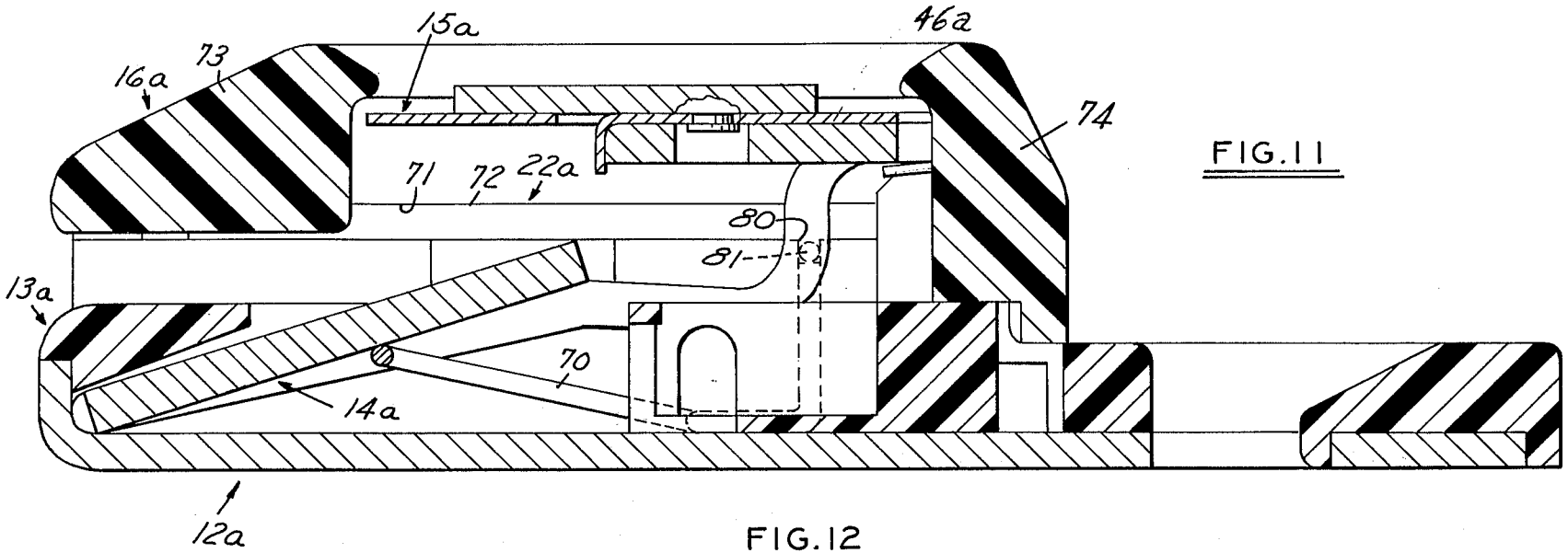
FIG. 11 is a sectional side elevation through the center of a modified buckle construction employing a plastic cover and auxiliary wire spring.

With reference to the enlarged sectional views of FIGS. 9 and 10 showing respectively the latched and release relationships of all components, the radiused ends 43 of the reaction legs 42 may be seen to project slightly farther than the center portion 61 resulting in a clearance at the center portion relative to the corner seat of the reaction flange 21 somewhat greater than the clearance between the upwardly formed latch lever side arms 47 and frame channel shoulder 62 so that upon ultimate capacity belt pull, legs 42 will deflect under initial load followed by engagement of reaction surfaces 47, 62 and finally end 61 with reaction flange 21 thereby ultimately distributing the reaction load over all such engaging surfaces to maximize capacity of the buckle. Upon reduction of belt tension, e.g. to a 150 pound test load, spring back of the legs 42 will open clearance between reaction surfaces 47, 62 so as to prevent interference with manual push button belt opening under such test loaded conditions. Under the buckle engaged condition of FIG. 9, preloaded spring arms 53 will be stressed sufficiently to urge the lever 14, latch end 45 into a light pressure engagement with the tongue end 33.

Depression of the push button to the position shown in FIG. 10 further deflects spring arms 53 lowering latch lever 14 to its release position. Recessed end 40 of frame 12 provided by lips 63 provides a plastic engagement surface 64 and lead out surface 65 to distribute load on the webbing around the thin frame to eliminate "cutting" of the webbing. Notched recessed end 27 engaging the upper end of flange 21 as well as lips 63 in plastic housing 13 locate the plastic housing 13 in nested relation with frame 12. Rounded nose 66 of housing 13 and rounded reverse bend 67 of cover 16 provide a guiding entry for tongue end 33. Flat tapered surface 44 and relatively light preload of spring arms 53 provide easy entry for tongue 11 upon manual insertion; and manual depression of push button 15 provides easy release for withdrawal of the tongue in the deflected position illustrated in FIG. 10.

With reference to the modified construction illustrated in FIGS. 11 to 14 the plastic cover **16*a* takes the place of the metal cover 16 of the preferred embodiment and an auxiliary wire spring 70 engages the underside of the latch lever 14*a*** to bias it into normal engaged position.

Figure 5:
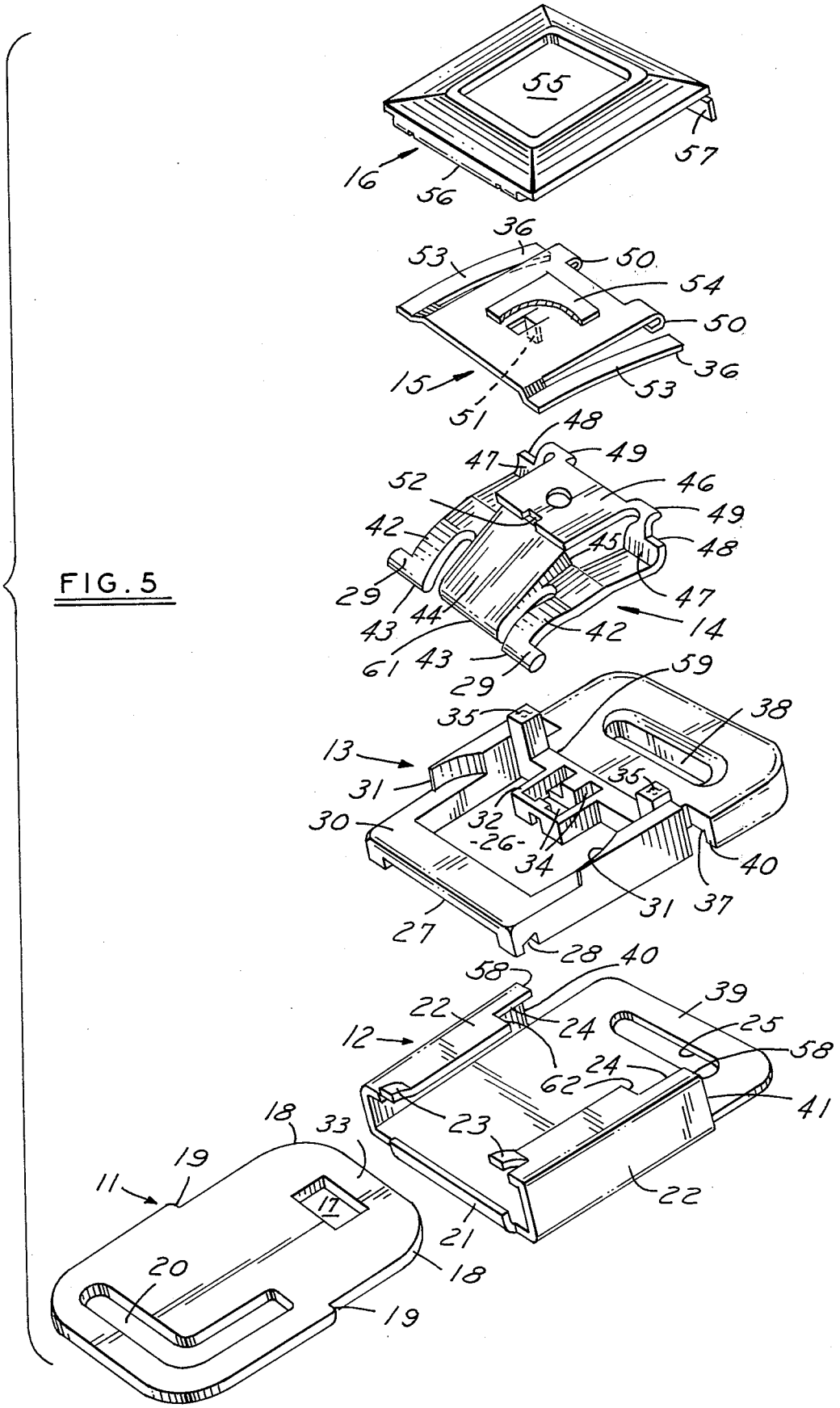
FIG. 5 is an exploded perspective view of the component parts of the assembly.
Figure 12:
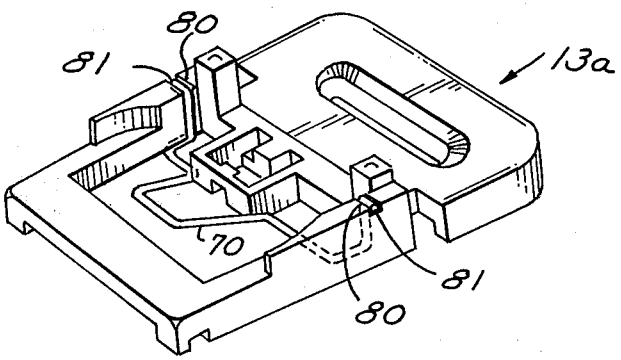
FIG. 12 is a perspective view of a plastic housing for the modified construction showing the auxiliary wire spring installed in place.
Figure 13:
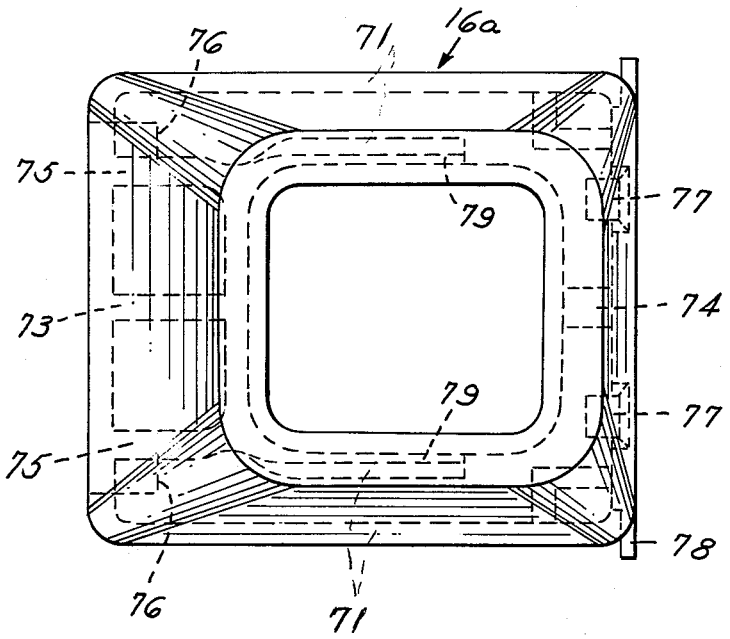
FIG. 13 is a plan view of the plastic cover.
Figure 14:
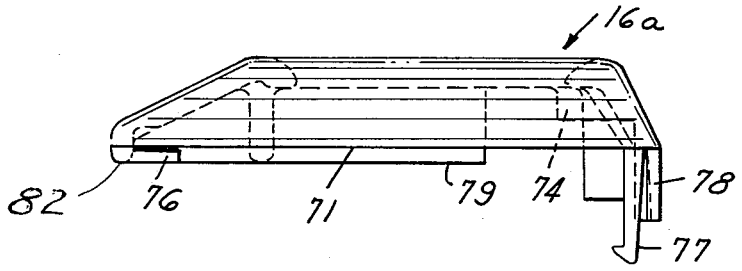
FIG. 14 is a side elevation of the plastic cover.

As best shown in FIG. 12 spring 70 is retained in plastic housing **13*a* which is substantially identical to the plastic housing 13 illustrated in FIG. 5 with the exception that right angle notches 80 are provided for retaining the right angle ends 81 of spring 70** which in free form are wider than in assembled position in the plastic housing so as to provide a spring tensioned assembly in the plastic housing.

Plastic cover **16*a* is similar in function to metal cover 16 with the exception that crush strength tests require that outer and inner perimeter surfaces 71 register against the upper surface 72 of flange 22*a* of metal frame 12*a* in an area occupied by spring arms 53 in the first embodiment. A lip 79 extending below the surface 71 between the innermost edges of the upper surface 72 of flanges 22*a* extend to include central rib 73 and side ribs 75 as well as rounded nose 82 to establish an upper guide surface for insertion of a metal tongue, such as tongue 11 illustrated in FIGS. 5 and 7, which will deflect the latch lever 14*a* down against the tension of spring 70, which in free form would extend to a level higher than illustrated in FIG. 11**, thereby producing latch engagement upon full insertion of the tongue.

Hook extensions 76 projecting from the lower surface of the ribs 75 and nose 82 engage struck projections of metal frame **12*a* similar to projections 23 illustrated in FIGS. 5 and 8** of the first embodiment, such metal frame being identical in both embodiments.

At the other end of the plastic cover central rib 74 extends downwardly to engage and retain plastic housing **13*a* against longitudinal displacement. Plastic retention fingers 77 engage recessed notches, not illustrated, which are formed in plastic housing 13*a***, when the plastic cover is snapped on into assembled position.

Push button 15*a*, which has no integral leaf springs such as 53 in the push button 15 of the first embodiment, is connected to upper push button support pad 46*a* of latch lever 14*a* in the same manner as the first embodiment and serves to depress the latch lever to a release position when actuated through the access opening in the center of the plastic cover.

From the foregoing description and inspection of FIGS. 1 to 4 it will be seen that the buckle provides rounded exposed surfaces at every extremity assuring comfortable manipulation; and no adjacent surfaces of component parts provide any opportunity for pinching the fingers upon opening and closing of the buckle. It will also be seen that the objectives of the invention for minimizing insertion and release forces, number of parts, cost of manufacture with components lending themselves to automated assembly, as well as compact neat appearance have been achieved.

I claim:

1. A safety belt buckle comprising component tongue, frame, housing, latch lever, spring push button, and cover means, said tongue having a latch aperture, said frame having a reaction flange pivotally engaged by said latch lever for movement between engagement and release relation with said latch aperture, said housing having means for relatively positioning said latch lever and said tongue within said frame, and said push button having required resilient means for effectively biasing said latch lever in said tongue engaging relation manually deflectable to said release relation said resilient means being integral with said push button anf further comprising the sole means for biasing said latch lever in said tongue engaging relation.

2. A buckle as set forth in claim 1 wherein said cover engages said frame and retains said housing with components other than said tongue in assembled relation.

3. A buckle as set forth in claims 1 or 2 wherein said reaction flange is formed as an "L"-shaped terminal end of said frame.

4. A buckle as set forth in claim 3 wherein said latch lever has arcuate side legs with ends pivotally engaging said reaction flange, and a central portion slightly spaced from said reaction flange in normal operation, said legs being resiliently deflectable under extreme belt loads to provide reaction engagement of said central portion with said reaction flange.

5. A buckle as set forth in claim 4 wherein said frame includes channel side elements and integral connecting frame base, the outer legs of said channels having reaction surfaces supplementing said reaction flange, said latch lever having angle formed projections remote from said pivotal engagement normally in close clearance proximity with said channel reaction surfaces and engageable therewith upon deflection of said reaction legs to absorb a portion of a latch lever load distribution on said frame under a condition of extreme belt loading, resiliency of said reaction legs serving to restore said normal clearance upon partial load release to predetermined test values of residual belt load thereby preventing interference with push button opening of the buckle with said residual load applied to the buckle.

6. A buckle as set forth in claim 5 wherein ultimate capacity belt loads are distributed over the reaction legs and center end portions of said latch lever engagement with said reaction flange, and said angle projections of said latch lever engagement with said channel leg reaction surfaces.

7. A buckle as set forth in claim 5 wherein said housing is recessed to cooperate with said channel sides of said frame to provide guide locating surfaces for said tongue.

8. A buckle as set forth in claims 1 or 2 wherein said latch lever includes a central ramp portion displaced to provide an engagement end for entering said tongue aperture, and a push button support surface having substantial contact area substantially displaced from the level of said latch engagement.

9. A buckle as set forth in claim 8 including means for attaching said push button in operative engagement with said support surface.

10. A buckle as set forth in claim 8 including means for attaching said push button in operative engagement with said support surface, said means including hook engagement means on said push button accommodating the application of leverage pressure to produce pivotal displacement of said latch lever against said resilient biasing means.

11. A buckle as set forth in claims 1 or 2 wherein said push button resilient means includes integral side spring arms.

12. A buckle as set forth in claim 11 wherein said housing includes reaction elements for engaging the ends of said spring arms.

13. A buckle as set forth in claim 5 wherein side angled projections at the end of said lever remote from said reaction flange extend to a level substantially beyond said channel sides, the outer extremities of said projections being integrally connected to a support surface for said push button.

14. A buckle as set forth in claim 13 wherein said housing is provided with spring reaction means extending substantially beyond said channel sides and said push button resilient means includes integral side spring arms engaging said spring reaction means.

15. A buckle as set forth in claim 13 wherein said spring push button comprises a relatively flat stamping with said push button resilient means having integral spring arms struck from either side and said push button also having integral end J-hook means for engaging an end extremity of said latch lever.

16. A buckle as set forth in claim 14 including a struck tab cooperating with said hook ends to attach said push button to said support surface of said latch lever.

17. A buckle as set forth in claim 1 wherein said housing comprises a molded plastic.

* * * * *